US005746137A

United States Patent [19]

Hawthorne et al.

[11] Patent Number: 5,746,137

[45] Date of Patent: May 5, 1998

[54] RAILCAR TRUCK BEARING ADAPTER CONSTRUCTION

[75] Inventors: Vaughn Terrey Hawthorne, Lisle; Charles P. Spencer, Staunton, both of Ill.; Terry L. Pitchford, St. Louis, Mo.

[73] Assignee: Amsted Industries Incorporated, Chicago, Ill.

[21] Appl. No.: 700,301

[22] Filed: Aug. 20, 1996

Related U.S. Application Data

[63] Continuation-in-part of Ser. No. 351,775, Dec. 8, 1994, Pat. No. 5,572,931.

[51] Int. Cl.[6] ..... B61F 5/00

[52] U.S. Cl. ..... 105/219; 105/218.1

[58] Field of Search ..... 105/218.1, 218.2, 105/219, 225, 224.1, 206.1, 220

[56] References Cited

U.S. PATENT DOCUMENTS

| | | | |
|---|---|---|---|
| 1,017,113 | 2/1912 | Slack | 105/225 |
| 1,466,892 | 9/1923 | Doerr | 105/219 |
| 1,476,463 | 12/1923 | Posson | 105/225 |
| 1,871,778 | 8/1932 | Clasen | 105/218.1 |
| 2,031,777 | 2/1936 | Johnson | 105/220 |
| 3,211,112 | 10/1965 | Baker . | |
| 3,274,955 | 9/1966 | Thomas . | |
| 3,276,395 | 10/1966 | Heintzel . | |
| 3,381,629 | 5/1968 | Jones . | |
| 3,621,792 | 11/1971 | Lisch . | |
| 3,699,897 | 10/1972 | Sherrick . | |
| 4,030,424 | 6/1977 | Garner et al. . | |
| 4,034,681 | 7/1977 | Neumann et al. . | |
| 4,072,112 | 2/1978 | Wiebe . | |
| 4,078,501 | 3/1978 | Neumann et al. . | |
| 4,082,043 | 4/1978 | Hammonds et al. . | |
| 4,103,623 | 8/1978 | Radwill . | |
| 4,103,624 | 8/1978 | Hammonds et al. . | |
| 4,108,080 | 8/1978 | Garner et al. . | |
| 4,192,240 | 3/1980 | Korpics . | |
| 4,236,457 | 12/1980 | Cope | 105/218.1 |
| 4,242,966 | 1/1981 | Holt et al. . | |
| 4,416,203 | 11/1983 | Sherrick . | |
| 4,428,303 | 1/1984 | Tack . | |
| 4,785,740 | 11/1988 | Grandy | 105/225 |
| 4,841,875 | 6/1989 | Corsten et al. . | |
| 5,572,931 | 11/1996 | Lazar et al. | 105/218.1 |

OTHER PUBLICATIONS

Car and Locomotive Cyclopedia (1974), Centennial Edition, pp. S1–25.

"Truck Hunting in the Three–Piece Freight Car Truck", by V.T. Hawthorne Aug. 1979, ASME, 18 pages.

*Primary Examiner*—Mark T. Le

*Attorney, Agent, or Firm*—Edward J. Brosius; F. S. Gregorczyk; Stephen J. Manich

[57] ABSTRACT

An integrally cast bearing adapter arrangement is provided in the pedestal of a railcar truck side frame, which side frame is cast with a pedestal jaw having a roof, and vertical walls of a first and second leg which roof and walls operate as a bearing adapter to receive and grasp a bearing assembly outer surface at a horizontal diameter of the bearing assembly for an axle end without introducing the manufacturing and assembly tolerances from discrete component assemblies, thereby avoiding the lateral displacement associated with the added tolerances and operating to minimize angular displacement between each mated axle and side frame.

5 Claims, 3 Drawing Sheets

RAILCAR TRUCK BEARING ADAPTER CONSTRUCTION

BACKGROUND OF THE INVENTION

The present application is a continuation-in-part application of parent application Ser. No. 08/351,775 filed Dec. 8, 1994 now U.S. Pat. No. 5,572,931.

FIELD OF THE INVENTION

The present invention relates to a bearing adapter assembly for a railcar truck. More specifically, tightly secured bearing adapters firmly hold the axle bearing in position to avoid angling and lateral axle variation, and the resultant truck "warping". Past research has illustrated railcar truck warping induces truck hunting during railcar travel, which warping causes undue wear on rails and wheels as well as increasing fuel usage.

DESCRIPTION OF THE PRIOR ART

In a three-piece railcar truck assembly, the side frames and bolster are generally square, that is the axles and bolster are approximately parallel to each other, and the side frames are parallel to each other but normal to the axles and bolster. After truck assembly and at certain railcar speeds, the truck may become dynamically unstable, which may be loosely defined as truck hunting. Truck hunting is defined in the Car and Locomotive Cyclopedia (1974) as "an instability at high speed of a wheel set (truck), causing it to weave down the track, usually with the (wheel) flanges striking the rail." Truck hunting has been the subject of many past and ongoing research efforts within the rail industry by truck suppliers, car builders and railroad lines, as this condition is undesirable from both operational and safety considerations. Past research efforts have noted a significant relationship between truck warping and resultant truck hunting. These research efforts and some of their conclusions are discussed in the ASME paper, "Truck Hunting in the Three-Piece Freight Car Truck" by V. T. Hawthorne, which paper included historical reference to still earlier research in this field. One of the earlier researchers noted " . . . that in the empty car the higher column force of the constant column damping provides a greater warp stiffness and, consequently, yields a higher critical (truck) hunting speed." The ASME paper described a project that was designed to measure the following parameters: warp stiffness; lateral damping force; and, lateral spring rate.

The warp stiffness results in this Hawthorne project duplicated earlier test results and it was noted that as the warp angle increased to 1° (60 minutes) of angular displacement, the warp stiffness dropped off appreciably. Further, it was noted that earlier warp stiffness data showed that 1° of displacement represented the maximum warp travel of a relatively new truck during hunting. Therefore, at warp angles prevalent in truck hunting, the warp stiffness fell considerably below the values necessary to raise the critical speed of hunting above the normal operating range of the freight railcar.

A field test noted that a new railcar truck running at a speed above 60 miles per hour with track inputs causing warp angles below 0.3° would not be expected to hunt. However, if the warp angle suddenly became 1.0° due to a track irregularity, it is expected that the critical truck hunting speed of the railcar would drop to about 52 miles per hour and intermittent truck hunting would occur.

A three-piece railcar truck generally allows a considerable amount of relative movement between the wheel and axle assembly, or the wheelset which includes the axle, wheels and the bearings, and the supporting side frame at the side-frame pedestal jaw. This may be due to manufacturing tolerances permitted in the various components, that is the side-frame pedestal jaw and bearing adapter, and to the form of the connection for the bearing adapter, the journal end of the wheelset and the integral jaws of the side frame structure. U.S. Pat. No. 3,211,112 to Baker discloses an assembly to damp the relative lateral movement between the wheel and axle assembly, and the associated side frame. More specifically, a resilient means or member is provided between the top of the journal end of the wheel and axle assembly, and the associated side frame member to produce varying frictional forces for damping the relative movement between the assembly and the side frame. The Baker—'112 patent recognized the undesirability of transmitting track perturbations through the wheelset, side frames and bolsters, but inhibition of this force transmission is intended to be accomplished by damping the disturbances caused by the lateral axle movements, not by suppressing their initiation.

In U.S. Pat. No. 3,274,955 to Thomas and also in U.S. Pat. No. 3,276,395 to Heintzel, a roller bearing adapter is illustrated with an elastomer on the upper part of the cap plate, which adapter is positioned in the side frame pedestal jaw with the elastomer between the pedestal roof and the adapter for relieving exposure to high stresses. A similar concept is shown in U.S. Pat. No. 3,381,629 to Jones, which provided an elastomeric material between each bearing assembly and the pedestal roof to accommodate axial movements of the bearing assemblies of each axle and to alleviate lateral impact to the side frame.

Other means have been utilized for maintaining a truck in a square or parallel relationship. In U.S. Pat. No. 4,103,623—Radwill, friction shoes are provided to frictionally engage both the side frame column and bolster. This friction shoe arrangement is intended to increase the restraining moment, which is expected to result in an increased truck hunting speed. The friction shoes had contact surfaces with some appropriate manufacturing tolerance to control initial contact areas to develop a maximum restraining moment.

U.S. Pat. No. 4,192,240 to Korpics provided a wear liner against the roof of a side-frame pedestal jaw. The disclosure recognized the detrimental effects of having a loose wear liner in the pedestal jaw. Wear liners are provided against the roof of the pedestal jaw to reduce wear in the roof caused by oscillating motions of the side frame relative to the wheel-axle assembly and the bearing. The disclosed wear liner included upwardly projecting tabs to grip the roof and side frame to inhibit longitudinal movement of the wear liner, and downwardly projecting legs to cooperate with the pedestal-jaw stop lugs to inhibit lateral movement of the wear liner relative to the roof. The stop lugs of the pedestal jaw are positioned on opposite sides of the depending legs of the jaw, which lugs are engageable with the downwardly depending wear liner legs.

U.S. Pat. No. 3,621,792 to Lisch provides a pedestal jaw opening with outwardly sloped sidewalls and a bearing adapter with sloped sidewalls positioned in the jaw opening. An elastomeric is positioned between the adapter and the pedestal sidewall and roof, which elastomer provides resistance in compression and yieldability in shear, and sufficient softness for cushioning. It is noted that by positioning the elastomeric pad between all the interfaces of the adapter and the pedestal jaw, metal-to-metal contact is prevented along with wear and transmission of noise and vibration from the track to the truck framing. Similarly in U.S. Pat. Nos. 3,699,897 and 4,416,203 to Sherrick, a resilient pad is provided between the bearing adapter and the side frame.

In U.S. Pat. No. 4,072,112 to Wiebe, an elastomeric positioning means is placed intermediate the bearing carrier and one of the pedestal jaws to bias the bearing carrier into direct communication or engagement with the opposite pedestal jaw to limit relative angular movement and linear displacement of the wheel set to the side frame.

U.S. Pat. Nos. 4,108,080 and 4,030,424 to Garner et al. teach a rigid H-frame truck assembly having resilient journal pads in the pedestal jaws. The truck provided by this development demonstrated improved riding characteristics. Similarly U.S. Pat. Nos. 4,082,043 and 4,103,624 to Hammonds et al. disclose an integral H-frame truck with resilient elements in the journal bearings.

In U.S. Pat. No. 4,242,966 to Holt et al., a railcar truck has a transom with a pair of tubes rigidly connected between the longitudinally extending side frames. The transom allows vertical movement of the side frames but resists longitudinal displacement of the side frames with respect to each other.

U.S. Pat. No. 4,841,875 to Corsten et al. provides a suspension arrangement with at least two annular elastomeric shock absorbers having an optimum adjustability in the longitudinal and transverse directions of the vehicle.

Alternative means for the insertion and securing of a wear liner against a pedestal jaw roof are taught in U.S. Pat. Nos. 4,034,681 and 4,078,501 to Neumann et al. and 4,192,240 to Korpics, which patents have a common assignee. The objective of these patent disclosures was to provide improved means for securing a wear liner in the jaw to minimize its movement and to improve the assembly means. The wear liners are provided with downwardly depending legs and stop lugs positioned to inhibit movement of the wear liner, such as in the lateral direction relative to the roof.

U.S. Pat. No. 4,428,303 to Tack illustrates a clip-on pedestal wear plate especially adapted for worn pedestal surfaces. A pair of wear plates, or a single member with a central portion of the plate removed, may be used to provide the structure of the invention.

All of the above disclosed apparatus disclose a journal assembly or an assembly for a railcar truck axle end, which assembly is operable in the pedestal jaw, and the disclosures recognized the desirability of keeping the truck side frames aligned with each other to avoid truck hunting. However, the several disclosures provided a plurality of resilient means or structures in the pedestal jaw and around the axle journal bearings, but none of the structures addressed the problem of maintaining the bearing adapter and consequently the axle and side frames in their aligned positions. Several of the above-noted references specifically utilized elastomeric or resilient components in the pedestal jaw or in association with the journal bearing to accommodate the disturbances and flexing motions experienced by the axles and side frames.

SUMMARY OF THE INVENTION

Side frames for a railcar truck have pedestals at both of its longitudinal ends with jaws to receive the journal ends of the axle shafts. These journal are generally provided with wheel bearings, which are mounted and secured in bearing adapters positioned in the pedestal jaws with the intent that the axles, usually two, of the truck remain aligned and parallel during railcar travel. The above-noted bearing adapters are generally secured in the pedestal jaw by means such as interlocking surfaces and frequently are provided with wear plates positioned between the adapter and the pedestal jaw roof to minimize wear from the repeated flexing of the adapter in the jaw during railcar travel.

The present invention provides an integrally cast bearing adapter in the roof of the pedestal jaw, which adapter is cast with the side frame and pedestal jaw and thereafter may be precision machined or otherwise finished. This secondary finishing accommodates the journal bearing on the axle end, avoids the build up of manufacturing tolerances from the assembly of a multiplicity of parts, and minimizes the flexural displacement in the jaw and bearing to more narrowly limit the lateral displacement of the axle and side frame assemblies to reduce railcar truck warping and consequent truck hunting. This integral jaw and bearing assembly reduces the lateral angular displacement below 1°, and in a preferred embodiment the displacement is less than 0.35°. It is recognized that truck hunting is not eliminated per se, but at the reduced angling and angles of lateral displacement, and thus reduced frequency of vibration, the critical speed, where truck hunting becomes a negative operating factor, is increased beyond the normal operating speed of the railcar.

In another embodiment, the cast-in-place adapter includes vertically extending arms, which have been machined to accept the journal bearing outer race. At assembly of the axle and bearing end into the adapter and pedestal jaw the inner walls of the downwardly depending legs of the bearing adapter accept the outer race and contact the outer surface of the race at, or below, the horizontal cross-sectional diameter of the axle. Contact of the inner walls of the cast-in-place bearing adapter provide a secure retention of the axle and bearing assembly to further inhibit and constrain lateral and rotational movement of the journal bearing outer race within the pedestal jaw, especially in the horizontal plane, thus avoiding warping and truck hunting.

BRIEF DESCRIPTION OF THE DRAWINGS

In the figures of the Drawing, like reference numerals identify like components and in the drawings.

DETAILED DESCRIPTION OF THE PREFERRED EMBODIMENT

Figure 6:
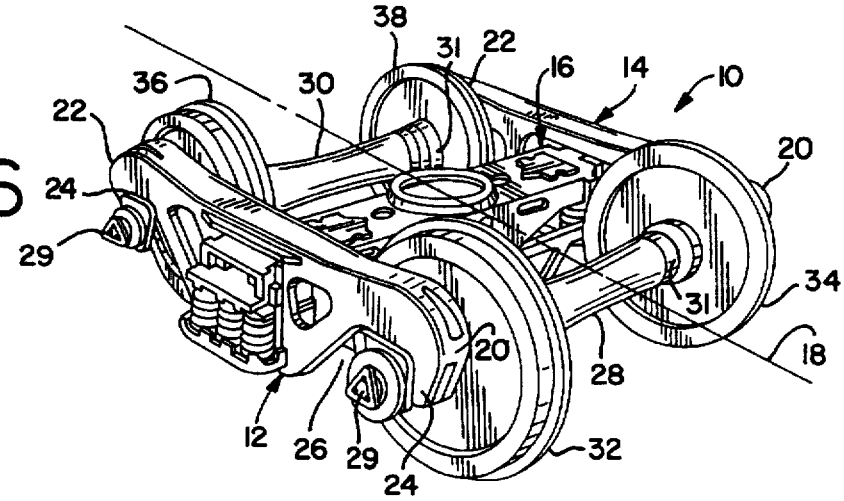
FIG. 6 is a oblique view of a railcar truck.

A railcar truck 10 as illustrated in FIG. 6 is generally an assembly of three main components, that is a first side frame 12, a second side frame 14 and a bolster 16 extending therebetween at about the midpoints of parallel side frames 12 and 14, which bolster 16 is about normal to each of side frames 12 and 14. Each of side frames 12 and 14 are about parallel to longitudinal axis 18 and include first end 20 and second end 22, which ends 20,22 each include a pedestal jaw 24 with a bearing opening 26. As each of the pedestal jaws 24 and bearing openings 26 are similar only one will be described, but the description will be applicable to each of openings 26 and jaws 24 of side frames 12 and 14.

In truck 10, first and second axles 28 and 30, which have wheels 32, 34, 36 and 38 positioned on their respective first axle-end 29 and second axle-end 31, are mounted at the respective first and second ends 20 and 22 of side frames 12 and 14, and extend therebetween about normal to longitudinal axis 18. The various ancillary elements of the truck, such as the spring pack and friction shoes, are not noted but typically are a part of a truck assembly 10.

Figure 2:
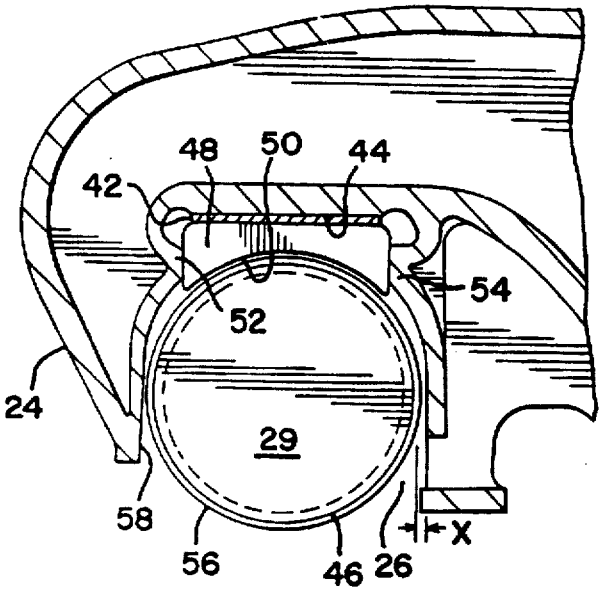
FIG. 2 PRIOR ART
FIG. 2 is a side elevation view of an exemplary prior art side-frame pedestal jaw with the wear plate, bearing adapter and axle end positioned therein.
Figure 3:
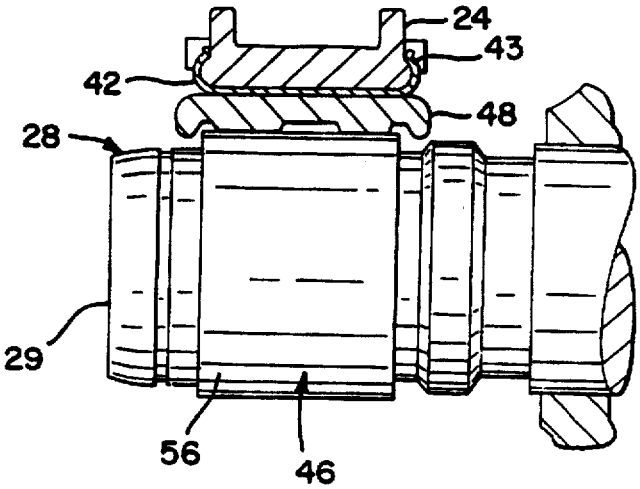
FIG. 3 PRIOR ART
FIG. 3 is a cross-sectional view of pedestal jaw, wear plate and bearing adapter with an axle and journal bearing positioned therein.
Figure 5:
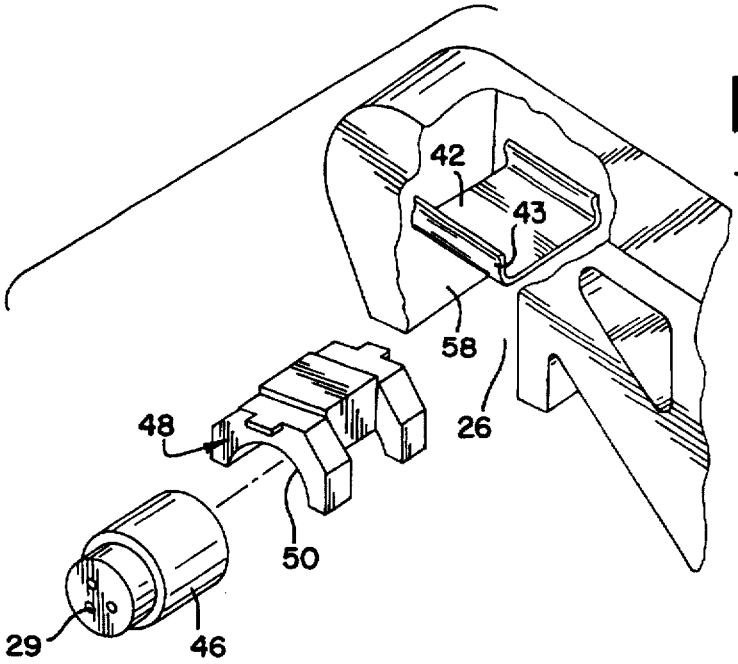
FIG. 5 PRIOR ART
FIG. 5 is an exploded view of an exemplary prior art pedestal jaw, wear liner, bearing adapter and journal bearing assembly.

In FIGS. 2, 3 and 5 enlarged and exploded views of an end of axle shaft 28 note a relatively common type of structure. In FIG. 2, axle shaft end 29 extends through pedestal jaw 24 and opening 26. Wear liner 42 is nested against roof 44 of jaw 24 and, journal bearing and bearing sleeve 46 are an annular bearing assembly, which is slidingly mounted on shaft end 29. Bearing adapter 48 is secured against wear liner 42 between thrust lugs 52 and 54 of jaw 24, which lugs 52, 54 extend into opening 26. Adapter 48 has arcuate surface 50 and is secured in opening 26 between lugs 52 and 54, and against wear liner 42. Journal bearing assembly 46 fits against arcuate surface 50 and is retained in jaw 24 and opening 26.

Indicative of the clearances provided in the assembly of axle end 40, pedestal jaw 24 and opening 26 is the separation 'x' in FIG. 2 between outer surface 56 of journal bearing 46 and the inner wall 58 of opening 26. This clearance is required both for the initial manufacturing process tolerances for the various parts of the assembly and for the purpose of providing adequate clearance for assembly of these parts.

The assembly of FIG. 2 is shown in a longitudinal cross-section in FIG. 3 with roof 44 of pedestal jaw 24 grasped by clips 43 of wear liner 42. Similarly in FIG. 5, the exploded view of axle end 29, journal bearing 46, bearing adapter 48 and wear liner 42 illustrates the plurality of parts in present axle and side frame assemblies. Accumulation of tolerances and clearances from these parts and their assembly provide gap distances in the final structure, which can lead to the amplification or increase in flexing between the axle and side frames during operation of truck 10 and consequently to the introduction of truck hunting.

Figure 1:
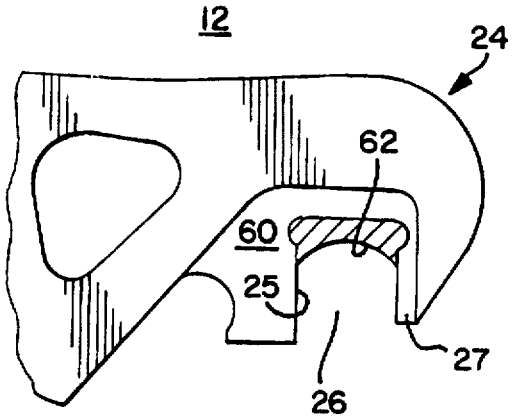
FIG. 1 is a side elevation view of a side frame and pedestal jaw with the as-cast and machined bearing adapter highlighted with sectional lines.
Figure 4:
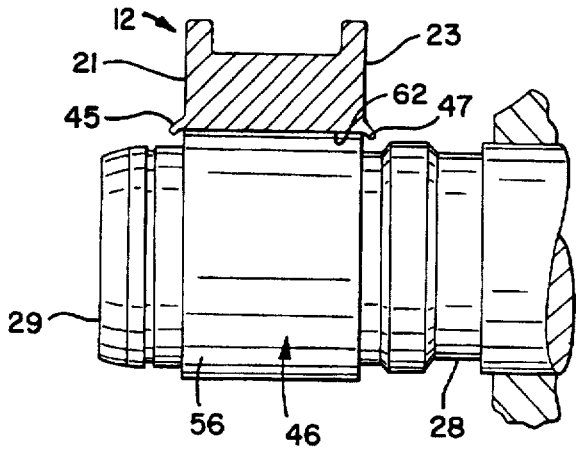
FIG. 4 is a cross-sectional view of the pedestal jaw and machined bearing adapter of the present invention with the axle and journal bearing positioned therein.

In FIGS. 1 and 4, the present invention demonstrates the improved structure which leads to the elimination of both independent bearing adapter 48 and wear liner 42, and to a reduction in the lateral angular displacement between axles 28 and side frames 12 and 14. In FIG. 1, a segment of side frame 12 has pedestal jaw 24 with inner pedestal leg 25, outer pedestal leg 27 and bearing adapter 60 outlined in a cross-hatched portion. However, bearing adapter portion 60 is an integral part of the side frame, but it is illustrated in outline form to note its position within pedestal jaw 24 and its relationship to opening 26. In this configuration, bearing adapter 60, which is the functional equivalent of adapter 48 in FIG. 2, is initially cast into side frame 12 and pedestal jaw 24. After casting, adapter 60 is machined or ground to provide the proper finish and arcuate contour at pedestal roof 44, which contoured arc 62 is similar to arc surface 50 of bearing adapter 48.

As illustrated in FIG. 4, journal bearing assembly 46 is securely mated against contoured arc 62 thereby avoiding the build-up of tolerances for each of wear liner 42 and bearing adapter 48. Thus, integrally cast adapter 60 has removed the availability of the manufacturing and assembly specification tolerances of wear liner 42 and bearing adapter 48 for reducing the ability of pedestal jaw 24 and opening 26 to retain and secure the axle 28 relatively tightly against angular displacement, which may lead to a reduction in truck hunting. First outwardly extending flange 45 extends outward from outboard surface 21 of side frame 12 and second outwardly extending flange 47 extends outwardly along axle 28 from inboard surface 23 of side frame 12. Each of flanges 45 and 47 are downwardly curved from roof 62 and are operable to maintain bearing assembly 46 on axle end 29 in its lateral position in side frame 12. Flanges 45 and 47 are integrally cast with bearing adapter 60.

Figure 7:
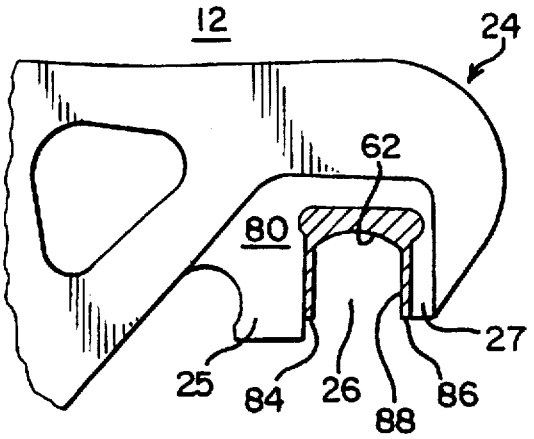
FIG. 7 is a side elevation of a side frame and pedestal jaw with the as-cast and machined bearing adapter of the separate embodiment having the extended depending legs highlighted with sectional lines; and, FIG. 8 is a side elevational view of the as-cast bearing adapter and pedestal jaw of FIG. 7 with an axle and bearing assembly nested and secured therein.

In FIG. 7, pedestal jaw 24 has bearing adapter 80 with arc contoured roof 62, inner depending leg 84 and outer depending leg 86. Bearing adapter 80 is an integral cast-in-place part of side frame 12 and pedestal jaw 24, but it is illustrated in outline form to clearly note its position and relationship to pedestal jaw 24 and opening 26. As shown in FIG. 7, legs 84 and 86 extend from and are clearly formed with roof section 62 to form adapter 80 with inner contoured wall 88. The effect on adapter 80, and its assembly with axle 29 and bearing 46, of incorporation of extended depending legs to adpater 80 is noted in FIG. 8.

Figure 8:
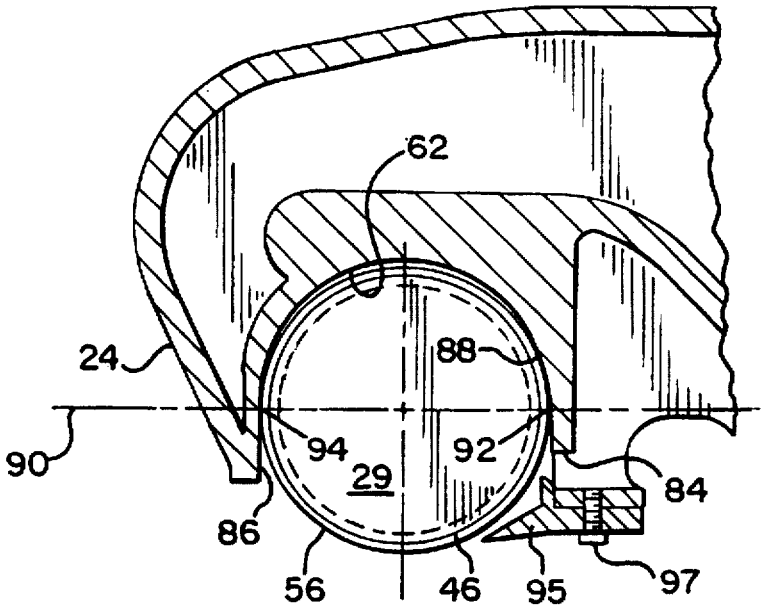

In the illustration of FIG. 8, axle end 29 of either axle 28 or 30 has horizontal cross-section diameter 90, which extends to first contact point 92 and second contact point 94 at surface 56 of bearing 46. In this configuration, depending legs 84 and 86, respectively, contact points 92 and 94 to firmly grasp axle end 29 and bearing 46 in opening 26. Further, in this illustration inner wall 88 conforms to the arcuate shape of axle end 29 and bearing 46 to securely nest these components in opening 26. As shown, the separation distance 'x' between outer surface 56 and inner wall 58 in FIG. 2 is eliminated or reduced to a negligible or tolerance value only necessary to permit assembly of the components. In this manner, securely grasping the assembly of axle end 29 and bearing 46 permits retention and constraint of this assembly within opening 26. Retention of assembly 29,46 in opening 26 further reduces lateral motion of assembly 29,46 and more specifically depending legs 84 and 86 extend below horizontal diameter 90 to constrain the assembly against horizontal displacement even in the event of a vertical displacement of such assembly, which vertical displacement would separate bearing outer surface 56 from contact with roof 62. However, as known in the art and shown in FIG. 8, a side frame key 95 is utilized to limit the amount of vertical displacement of axle end 29 in opening 26. Key 95 is secured to side frame 12 by locking bolt 97 in proximity to inner depending leg 84 in this figure and is only noted as an exemplary illustration of such known keys.

The magnitude of improvement of the angular displacement of axle 28 has been demonstrated by reduction of displacement from about 1° to less than 0.50° during testing. As noted above in earlier research work, decreasing the angular displacement results in improved truck hunting, or more accurately has been noted to increase the critical speed where truck hunting commences. Therefore, the improvement attributable to this greater or tighter retention of bearing assembly 46, and thus axle 28, is readily apparent, as this avoids truck warping or parallelogramming which reduces truck hunting. Firmer retention of bearing assembly 46 and axle 28 at the side frame cooperates with the improved degree of freedom offered with the modern snubbers or friction shoes (not shown) and bolster 16 assemblies to provide the rigidity and stability to truck assemblies 10 to avoid truck warping without the added structural members from supplemental apparatus, such as steering arms. If it is considered necessary to provide better wear characteristics on surface 62 of jaw 24, arcuate surface 62 may be hardened or coated by means known in the art, such as plasma spraying or plating.

While only a specific embodiment of the invention has been described and shown, it is apparent to those skilled in the art that various alternatives and modifications can be made thereto. It is, therefore, the intention in the appended claims to cover all such modifications and alternatives as may fall within the true scope of the invention.

We claim:

1. In a side frame of a railcar truck, said side frame having a first end, a second end, an inboard surface, an outboard surface, a first longitudinal axis, a first pedestal with an integrally cast bearing adapter at said first end, and a second pedestal with an integrally cast bearing adapter at said second end, a plurality of generally cylindrical axles, each said axle having an outer wall, a second longitudinal axis, a first axle end, a second axle end and a generally circular cross-section, a plurality of journal bearing assemblies having an outer surface, one of said bearing assemblies mounted on each said first and second axle ends, each said axle cross-section having a generally horizontal diameter extending through said second longitudinal axis, said diameter extending to intersect said journal bearing outer surface at a first contact point and a second contact point, each said side-frame pedestal first and second end having a first and generally vertical depending leg, a second and generally vertical depending leg and a jaw roof connecting said first and second legs, each said jaw roof, first depending leg and second depending leg at each said first and second pedestal cooperating to define a pedestal jaw and an opening generally opposite said roof, each said jaw roof, said first depending leg and said second depending leg having an inner wall, said jaw roof, said first depending leg and said second depending leg at each side frame first and second pedestal cooperating to accommodate a cast-in-place bearing adapter to receive and secure said bearing assembly and axle end in said opening, each said bearing adapter having an adapter roof and extending side arms directly engaging a journal bearing assembly on an axle end, said first longitudinal axis and said second longitudinal axis at each said bearing adapter generally perpendicular at an as-assembled, reference position, said extending side arms downwardly extending from said adapter roof at least to contact said journal bearing outer surface at said first and second contact points at angular displacement of said axle end in said bearing adapter to maintain said axle end and journal bearing in an approximately fixed relationship with a bearing assembly on said second end of said axle, which second axle end is positioned in a bearing adapter of a second side frame opposite and generally parallel to said first side frame.

2. In a side frame of a railcar truck as claimed in claim 1, wherein said adapter roof has an arc contoured surface, said bearing assembly having a generally cylindrical outer surface, said adapter roof arc contour surface matable with said bearing assembly outer surface to securely maintain said bearing assembly and axle end in said approximately fixed relationship.

3. In a side frame of a railcar truck as claimed in claim 1 wherein inner walls of said bearing adapter are machined and cooperate to define a finished tolerance size distance between said extending side arms to receive and contact said bearing assembly outer surface at about said horizontal diameter and to provide said adapter roof with an arc contoured surface for mating with said bearing assembly outer surface.

4. In a side frame of a railcar truck as claimed in claim 3 wherein inner walls forming said bearing adapter are treated by at least one of coating and flame spraying to provide a hardened surface.

5. In a side frame of a railcar truck as claimed in claim 1 wherein said extending side arms vertically extend downward below said first and second contact points to maintain a contact between the bearing outer surface and extending side arms during a vertical displacement of said axle end assembly and angular displacement from said reference position of said axle end.

* * * * *